US005478137A

United States Patent [19]

Olson et al.

[11] Patent Number: 5,478,137

[45] Date of Patent: Dec. 26, 1995

[54] ARMREST ADAPTOR ASSEMBLY

[75] Inventors: Ogden R. Olson; Craig H. Schultz, both of Muscatine, Iowa

[73] Assignee: Hon Industries Inc., Muscatine, Iowa

[21] Appl. No.: 228,318

[22] Filed: Apr. 15, 1994

[51] Int. Cl.[6] ..... A47C 7/54

[52] U.S. Cl. ..... 297/411.26; 297/227; 297/411.46

[58] Field of Search ..... 297/227, 411.20, 297/411.21, 411.26, 411.38, 411.45, 411.46; 248/118

[56] References Cited

U.S. PATENT DOCUMENTS

| | | | |
|---|---|---|---|
| 4,597,606 | 7/1986 | Magee | 297/411.2 X |
| 4,795,211 | 1/1989 | Stern et al. | 297/411.26 X |
| 5,064,247 | 11/1991 | Clark et al. | 297/452.38 X |
| 5,234,251 | 8/1993 | Ayotte | 297/411.26 X |
| 5,290,087 | 3/1994 | Spykerman | 297/411.21 X |

FOREIGN PATENT DOCUMENTS

| | | | |
|---|---|---|---|
| 81003115 | 11/1981 | WIPO | 297/411.2 |

*Primary Examiner*—Peter R. Brown
*Attorney, Agent, or Firm*—Jones, Day, Reavis & Pogue

[57] ABSTRACT

An assembly for affixing an arm pad to an arm rest of the chair without using a visible fastener and without the need to fashion a hole in the arm rest. The assembly comprises two shells which fit on the arm rest which have a variety of latching projections. An insert molded within a resilient arm pad has a corresponding variety of ports. Shells are fitted onto the arm rest. Upon pressing the insert within the arm pad against the shells, the projections on the shells latch the corresponding ports in the insert within the arm pad.

24 Claims, 12 Drawing Sheets

ARMREST ADAPTOR ASSEMBLY

FIELD OF THE INVENTION

This invention relates to the assembly of an arm pad to an arm rest of a chair, and it relates more particularly to the construction of an armrest and arm pad assembly in which the arm pad is secured to the arm rest without the need for screws.

DESCRIPTION OF THE PRIOR ART

The conventional means for attaching the arm pad to the arm rest often involves cutting a hole through the arm rest to facilitate the use of a bolt or a screw to fasten the arm pad to the arm rest. The step of the manufacturing process in which the holes are cut or punched in the arm rest can require extensive energy demands especially if the arm rest is made of metal. Hence, it is desirable to provide an inexpensive device for attaching the arm pad to the arm rest without punching or cutting a hole in the arm rest.

For aesthetic purposes, it is desirable to hide the device which is used to fasten the arm pad to the arm rest from sight. This is frequently done by punching a hole in the arm rest, attaching a fastening device to the underside of the arm pad, and securing the fastening device through the punched hole. This way is undesirable of course because it requires the steps of punching one or more holes and fastening the arm pad by screws.

Accordingly, an object of the invention is to provide an assembly for adapting an arm pad to an arm rest of a chair without having to fashion a hole in the arm rest to effect the attachment. Another object of the invention is to attach an arm pad to an arm rest of a chair without using any visible fasteners.

SUMMARY OF THE INVENTION

The present invention uses a first shell and a second shell made of rigid plastic and contoured to correspond with the contour of the arm rest. The two shells are mirror images of each other and, preferably have a C-shaped cross section which snugly fits around a portion of the arm rest. The two shells each have a horizontal component and a vertical component. The horizontal component of each shell has a first raised finger and a second raised finger both with a beveled lip extending outwardly. The first raised finger on the first shell is disposed in registry with the first raised finger on the second shell, and the second raised finger on the first shell is disposed in registry with the second raised finger on the second shell. Hence, when the two shells are fitted onto the arm rest, two pairs of aligned raised fingers are provided.

A first L-shaped bracket with a vertical flange and a horizontal flange is attached by the horizontal flange to the vertical component of the first shell. A second L-shaped bracket with the same construction is attached in the same way to the second shell. When the first shell and the second shell are fitted onto the arm rest, the first and second L-shaped brackets are evenly aligned.

A plastic insert has a horizontal component and a vertical component with basically the same contour as the two shells. The horizontal component of the insert has two rectangular depressions and a rectangular port cut through each depression. The ports have basically the same axial location on the insert as each pair of raised fingers on the shell. Moreover, a duct with a recessed shelf suspended from a top edge thereof has the same location on the insert as the L-shaped brackets on the two shells. The insert also has a plurality of apertures.

An arm pad made of a resilient material is molded around the plastic insert. The underside of the arm pad is molded with a channel to allow access to the ports and to the duct from the underside. The apertures on the insert allow for the resilient material to flow through and permeate the insert during molding to provide a strong bond between the insert and the arm pad.

To install the arm pad to an arm rest, the two shells are secured to the arm rest with the two raised fingers projecting upwardly and the L-shaped brackets extending forwardly. The arm pad is placed on top of the shells with the pairs of raised fingers and the pair of L-shaped brackets protruding into the channel to access the insert. The shelf on the duct of the insert within the pad slidably engages the vertical flanges of the L-shaped bracket on the vertical component of the shell. Additionally, the ports on the insert are pressed down on the raised fingers, so that the ridges on the ports descend below the outwardly extending lips to latch the arm pad and the insert to the shells. Beveled edges on the extended lips and on the ridges of the ports facilitate the latching arrangement. Once the insert within the arm pad is latched to the shells, removal of the arm pad and insert is not easily effected. Consequently, the arm pad is attached to the arm rest without having to form a hole in the arm rest and without there being any visible sign of attachment.

BRIEF DESCRIPTION OF THE DRAWINGS

In the drawings which illustrate the present invention.

DETAILED DESCRIPTION

Figure 1:
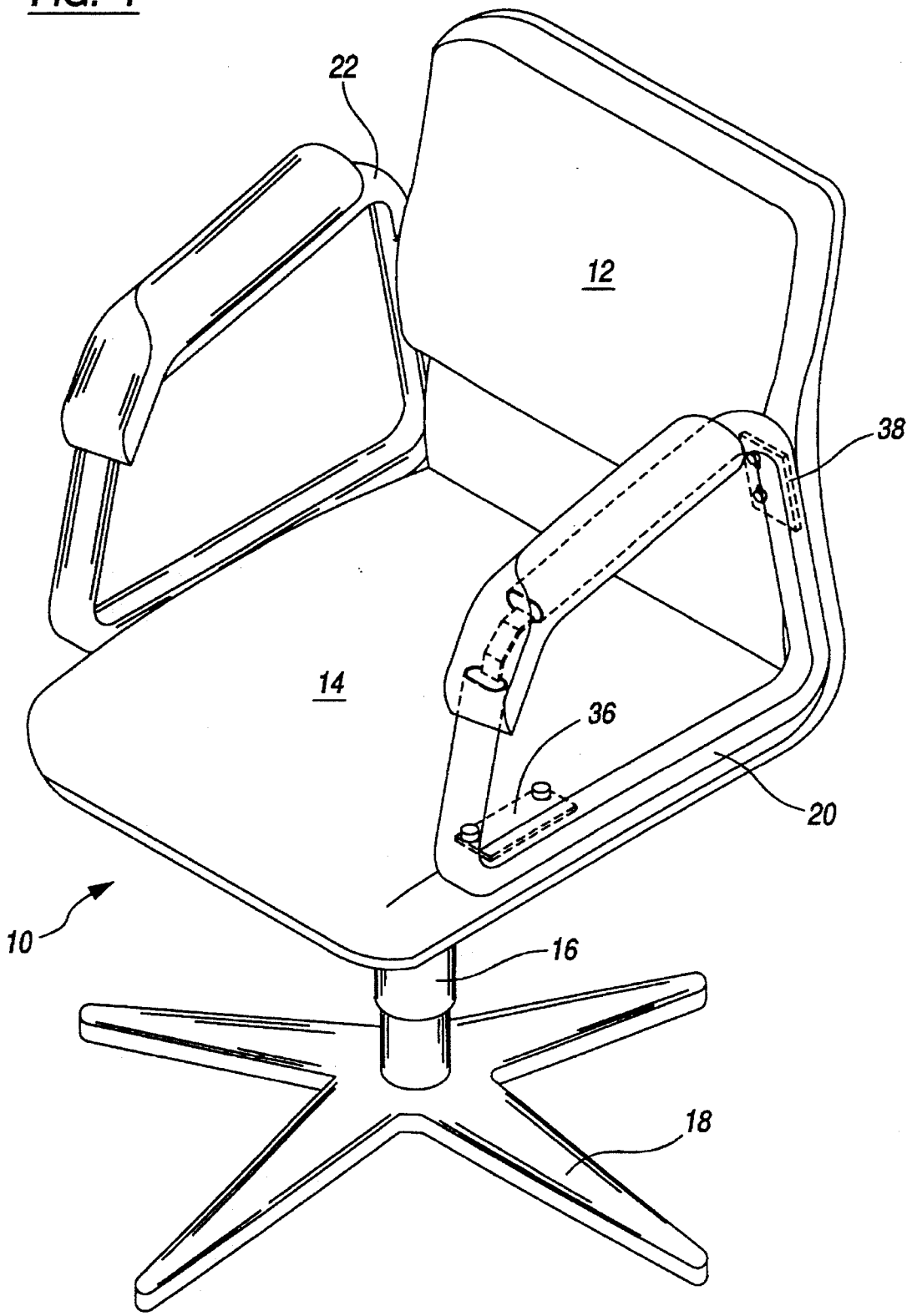
FIG. 1 is an isometric view of a chair incorporating an arm rest adapter assembly of the present invention.

Turning now to the drawings, FIG. 1 shows a chair 10 which incorporates an arm rest adaptor assembly of the present invention. The chair 10 has a back 12, a seat 14, a support 16, a base 18 and two arm rests 20, 22. Although the invention can be used on both arm rests, only adaption of the invention on the armrest 20 will be described.

Figure 2:
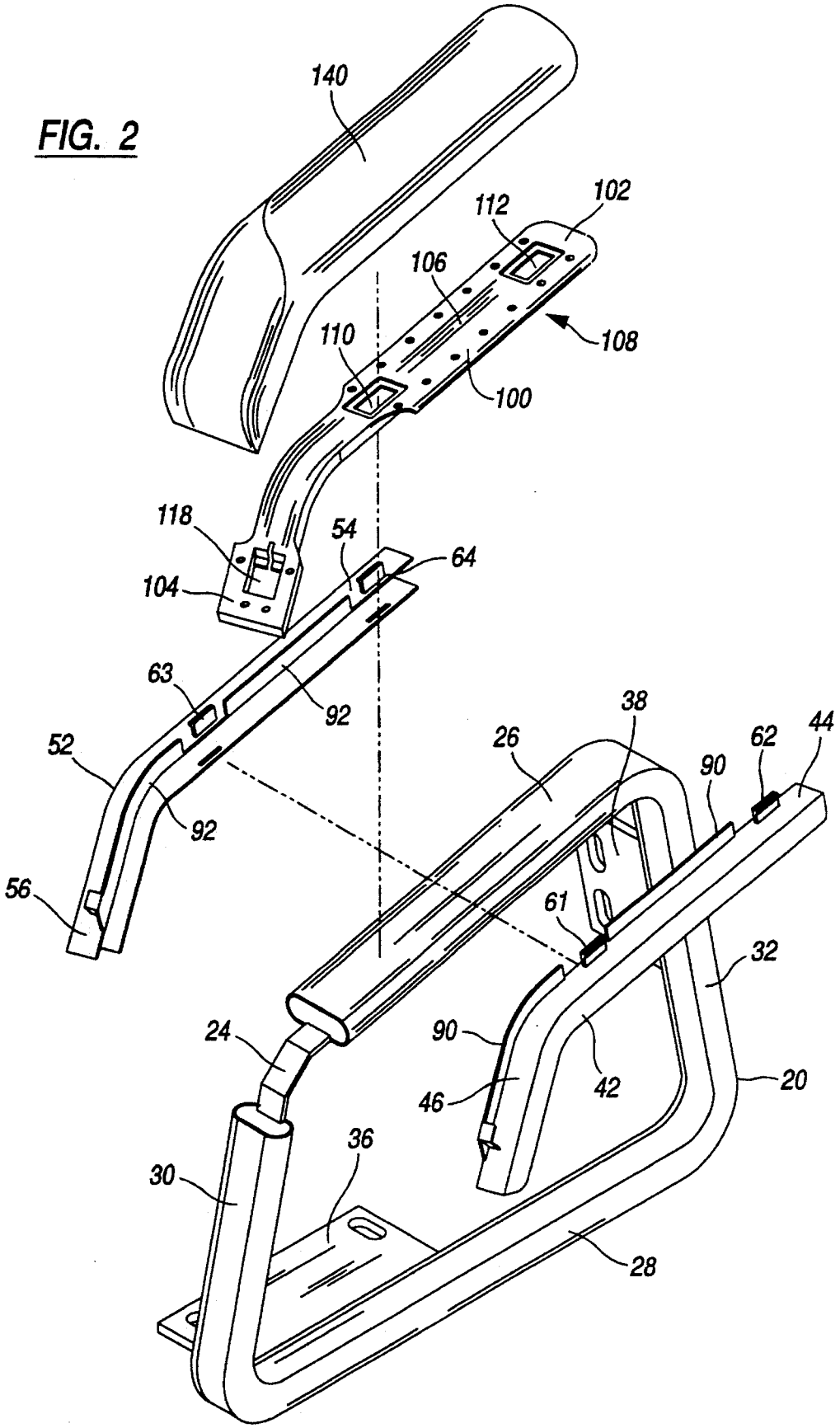
FIG. 2 is an exploded isometric view of the arm rest adapter assembly.

As shown in the exploded drawing of FIG. 2, the armrest 20 normally has a metal tubular construction which is bent into a slightly-opened loop. A die-formed bracket 24 is welded into the interruption in the loop to maintain the looped configuration of the arm rest 20. The armrest 20 has a top portion 26, bottom portion 28, a front portion 30 and a back portion 32. A flange 36 with two apertures is welded to the bottom portion 28 of the armrest 20. Any attachment means can be used to secure the armrest 20 to the seat 12 of the chair 10 via flange 36 as shown in FIG. 1. A flange 38 with two apertures is also welded to the back member 32 of the armrest for attaching the back member 32 of the armrest 20 to the back 12 of the chair 10 with any acceptable attachment means.

A first shell 42 has a horizontal component 44 and a vertical component 46, which is configured to have the same overall contour as that of the top 26 and front 30 of the armrest 20. The first shell 42 has a C-shaped cross-sectional configuration for sliding over and receiving a first longitudinal half of the armrest 20. Once the first shell 42 is installed on the first longitudinal half of the armrest 20 as shown in FIG. 3, the horizontal component 44 of the first shell 42 extends along a portion of the top member 26 of the armrest and the vertical component 46 of the first shell 42 extends along a portion of the front member 30 of the armrest 20.

A second shell 52 which is a symmetrical opposite to the first shell 42 has a horizontal component 54 and a vertical component 56. The second shell 52 slides over a second longitudinal half of the armrest 20 and the horizontal component 54 of the second shell 52 extends along a portion of the top member 26 of the armrest 20 and the vertical component 56 of the second shell 52 extends along a portion of the front member 30 of the armrest 20 as shown in FIG. 3. Once installed, both shells 42, 52 combine to form a sleeve 60 which covers the bracket 24 in the interruption in the loop and a portion of the front member 30 and the top member 26 of the arm rest 20.

Figure 3:
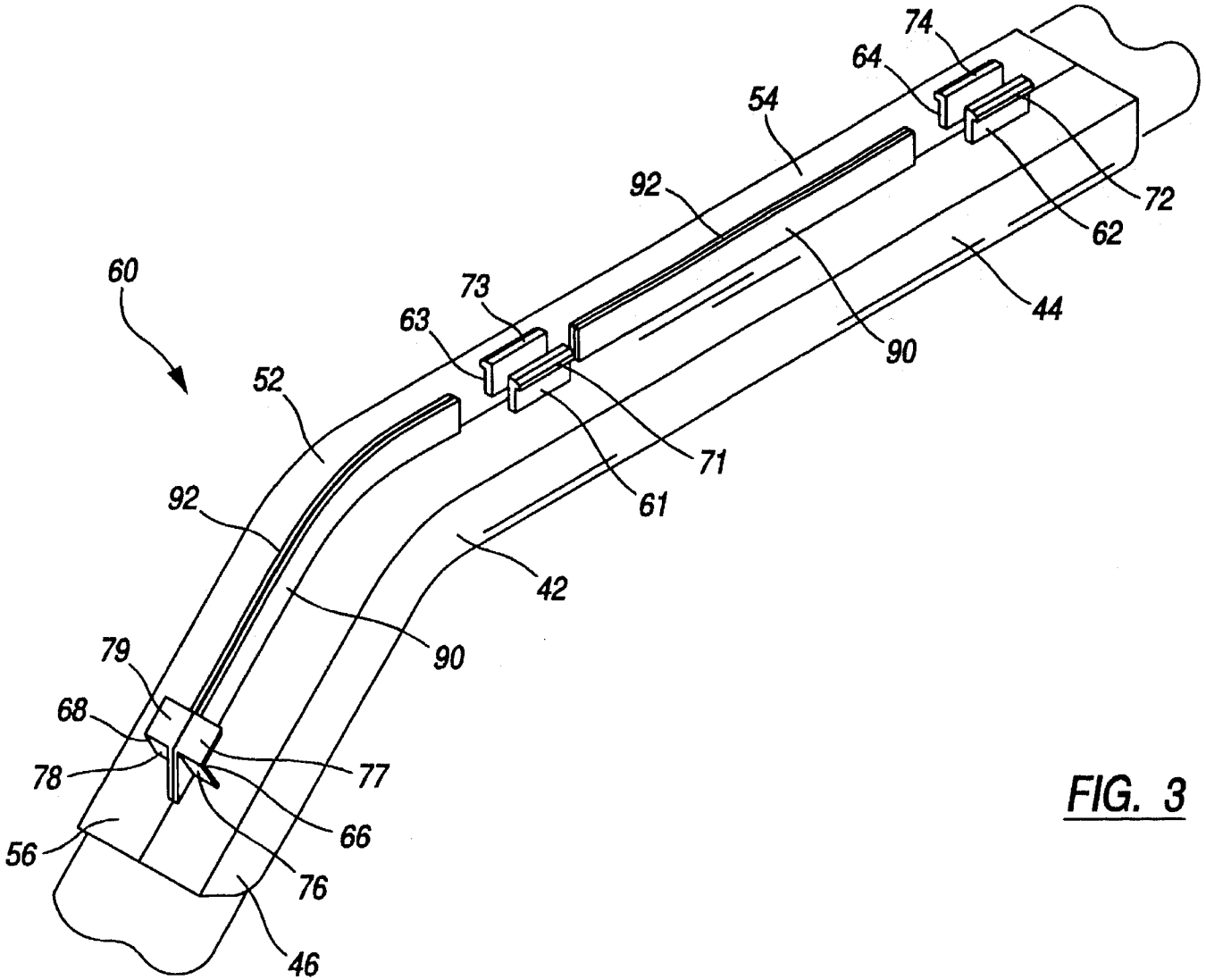
FIG. 3 is an isometric view of a first shell and a second shell assembled onto an arm rest.

As best shown in FIG. 3, the horizontal component 44 of the first shell 42 has a first upwardly raised finger 61 and a second upwardly raised finger 62. The first upwardly raised finger 61 has a beveled outer edge 71 which projects outwardly from the finger 61, and the second upwardly raised finger 62 has a beveled outer edge 72 which projects outwardly from the finger 62.

The second shell 52 also has a first upwardly raised finger 63 and a second upwardly raised finger 64 at identical locations as the first and second raised fingers 61, 62 on the first shell 42, respectively. The first upwardly raised finger 63 has a beveled outer edge 73 which projects outwardly from the finger 63, and the second upwardly raised finger 64 has a beveled outer edge 74 which projects outwardly from the finger 64.

A first L-shaped bracket 66 with a horizontal flange 76 and a vertical flange 77 is disposed on the vertical component 46 of the first sleeve 42. The first L-shaped bracket 66 is attached to the first shell by the horizontal flange 76. A second L-shaped bracket 68 with a horizontal flange 78 and a vertical flange 79 is attached to the second shell 52 at an identical location as on the first shell 42 by the horizontal flange 78.

An upwardly extending fin 90 is positioned along an inner edge of the first shell 42 and is interrupted by the finger 61. An upwardly extending fin 92 is positioned along an inner edge of the second shell 52 and is interrupted by the finger 63.

Figure 4:
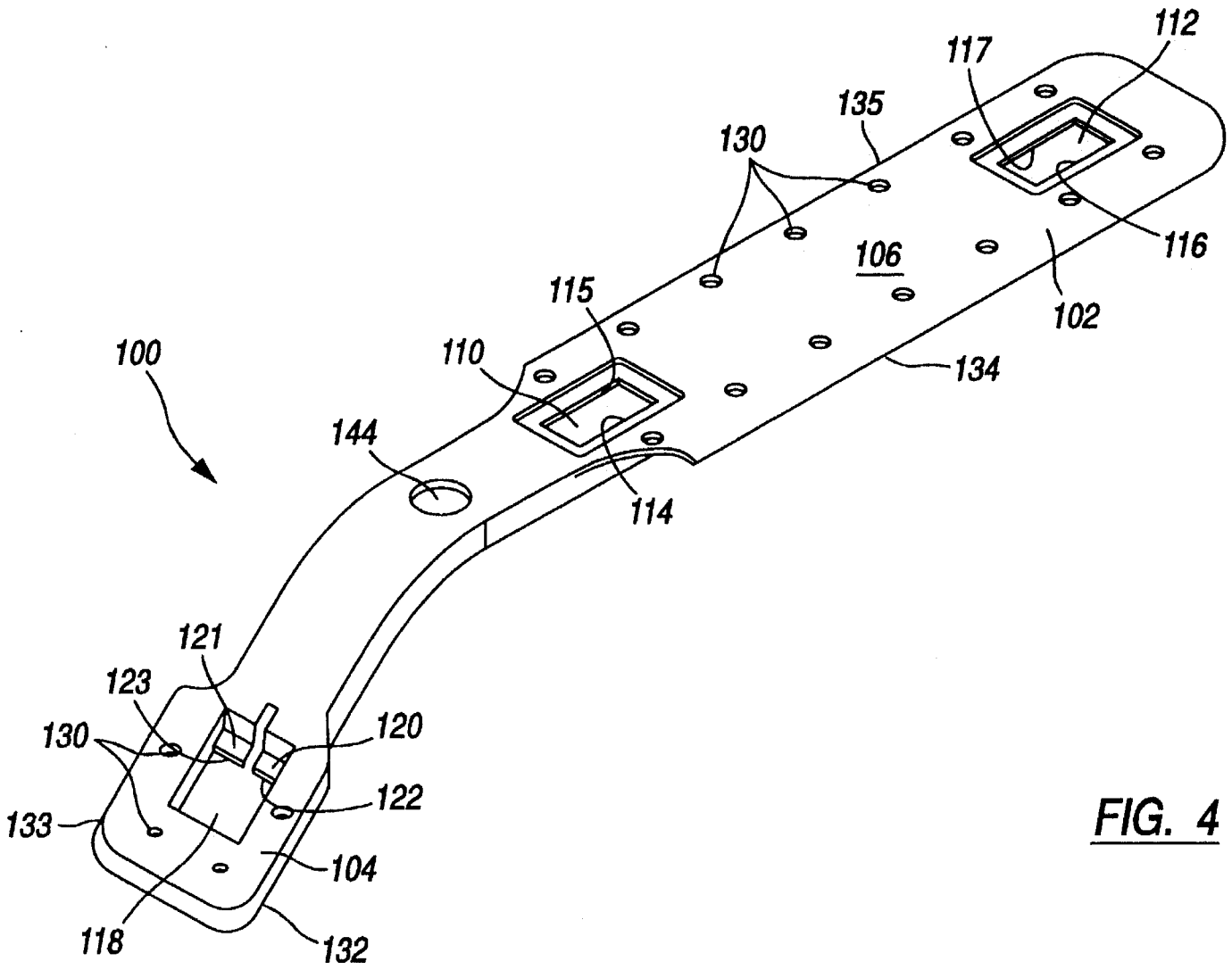
FIG. 4 is an isometric view of a top side of an insert.
Figure 5:
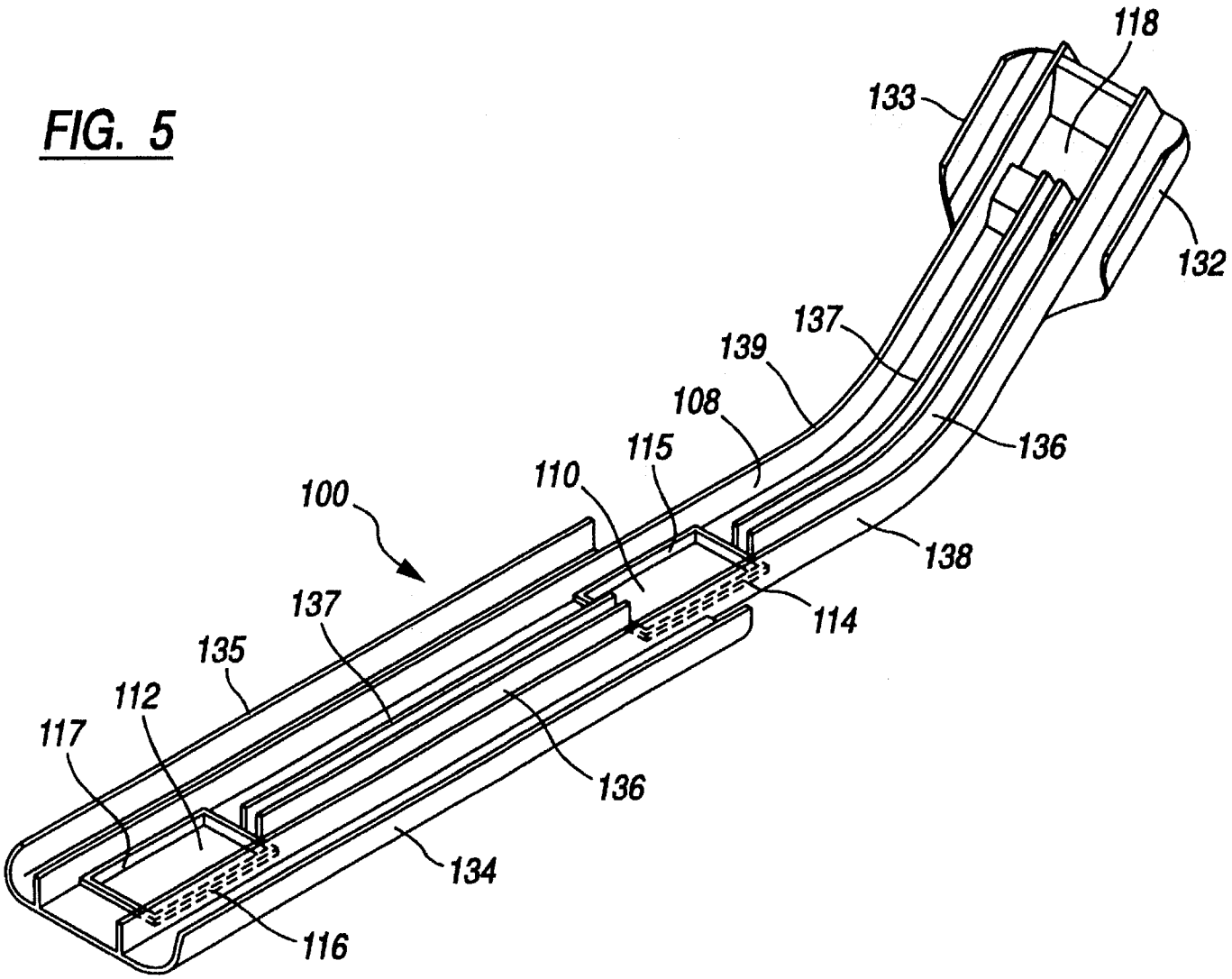
FIG. 5 is an isometric view of an underside of an insert.

FIG. 2 shows an insert 100 made of rigid plastic material. FIG. 4 shows the top face of the insert 100, and FIG. 5 shows the underside of the insert 100 in more detail. The insert 100 has the same contour as the first and second shells 42, 52. The insert 100 also has a horizontal component 102, a vertical component 104, a top face 106 and an underside 108. The horizontal component 102 of the insert 100 has a first rectangular depression 107 and a second rectangular depression 109 in the top face 106. A first rectangular port 110 is cut through the first depression 107 at a location on the insert 100 which can be aligned with the location of the raised finger 61 on the first shell 42 and the raised finger 63 on the second shell 52. A second rectangular port 112 is cut through the second depression 109 at a location on the insert 100 which can be aligned with the location of the raised finger 62 on the first shell 42 and the raised finger 64 on the second shell 52.

The first port 110 has a first ridge 114 and a second ridge 115 which are both beveled on the underside 108 as shown in FIG. 5. The second port also has a first ridge 116 and a second ridge 117 which are both beveled on the underside 108.

A third port or duct 118 is cut through the vertical component 104 of the insert 100. Bifurcated shelves 120 and 121 extending from a top edge of the third port 118 and ending in beveled edges 122 and 123, respectively, are recessed below the top face 106 of the insert 100. A plurality of apertures 130 are cut from the top face 106 through the underside 108 of the horizontal component 102 and the vertical component 104 of the insert 100.

Several fins are provided on the underside of the insert 100. Portions of the outside edges of the insert are curved downward, forming a pair of outside fins 132, 133 on the vertical component and a pair of outside fins on the horizontal component 134, 135. A pair of inside fins 136, 137 run down a center of the underside 108 of the insert 100 and are interrupted by the first port 110. A structural fin 138 runs along the length of the underside 108 of the insert 100 between the inside fin 136 and the outside fins 132, 134. A structural fin 139 runs along the length of the underside 108 of the insert 100 between the inside fin 137 and the outside fins 133, 135.

Figure 6:
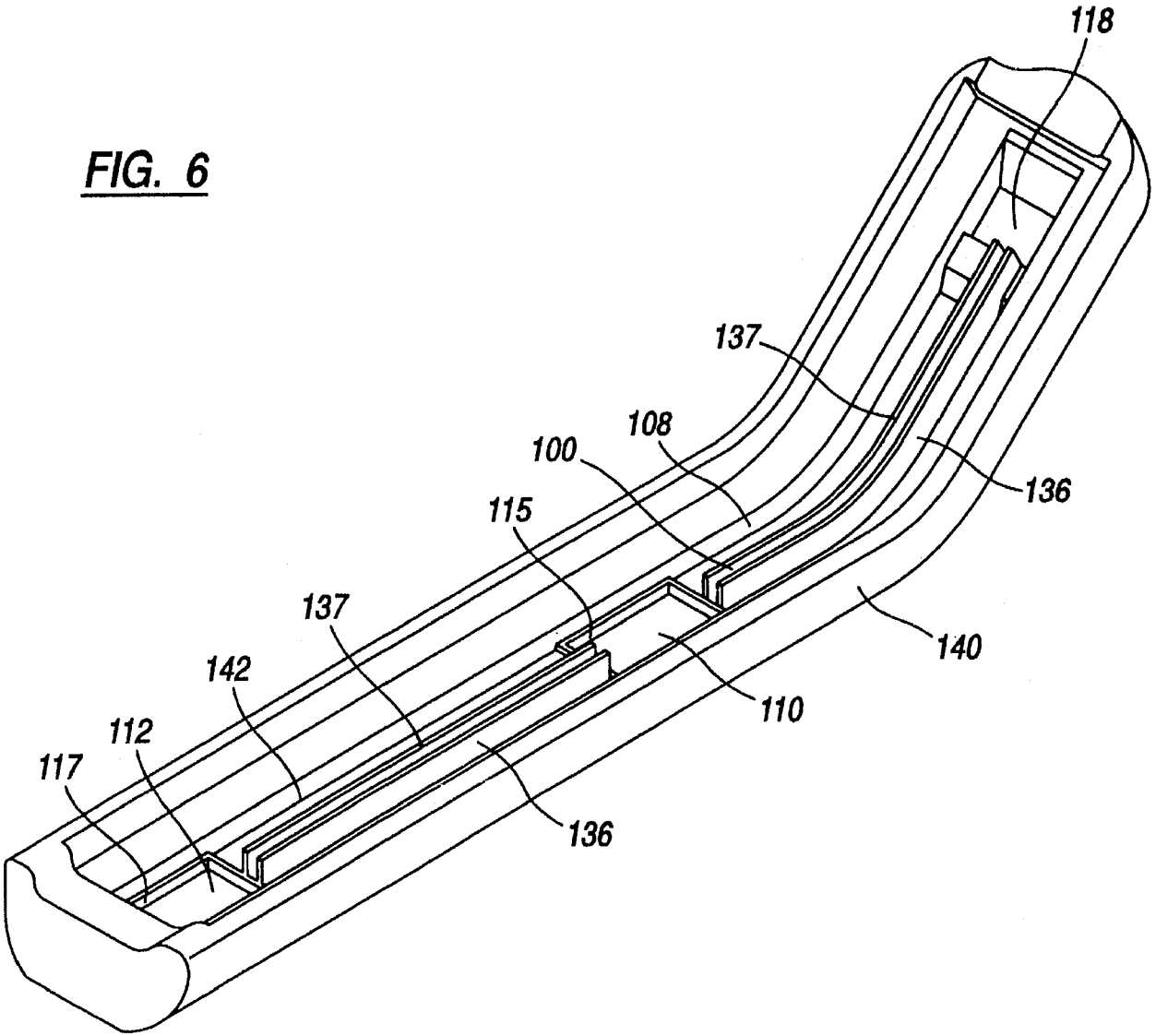
FIG. 6 is an isometric view of an underside of the insert within an arm pad.

FIG. 2 shows an arm pad 140 removed from the insert 100. The arm pad is made of a resilient moldable plastic, preferably polyurethane. The arm pad 140 is molded to completely envelope the insert 100, as shown in FIG. 6. However, a channel 142 running down the inside of an underside of the arm pad provides access to the first port 110, the second port 112 and the third port or duct 118. A top side of the pad 140 is soft to provide a cushiony surface.

To mold the pad 140 to the insert 100, the insert 100 is placed within a plastic injection mold and the plastic is injected into the mold around the insert 100 through the threshold port 144. The plurality of apertures 130 in the insert 100 facilitate the molding process by allowing the injected plastic to flow around and permeate through the insert 100.

Figure 7A:
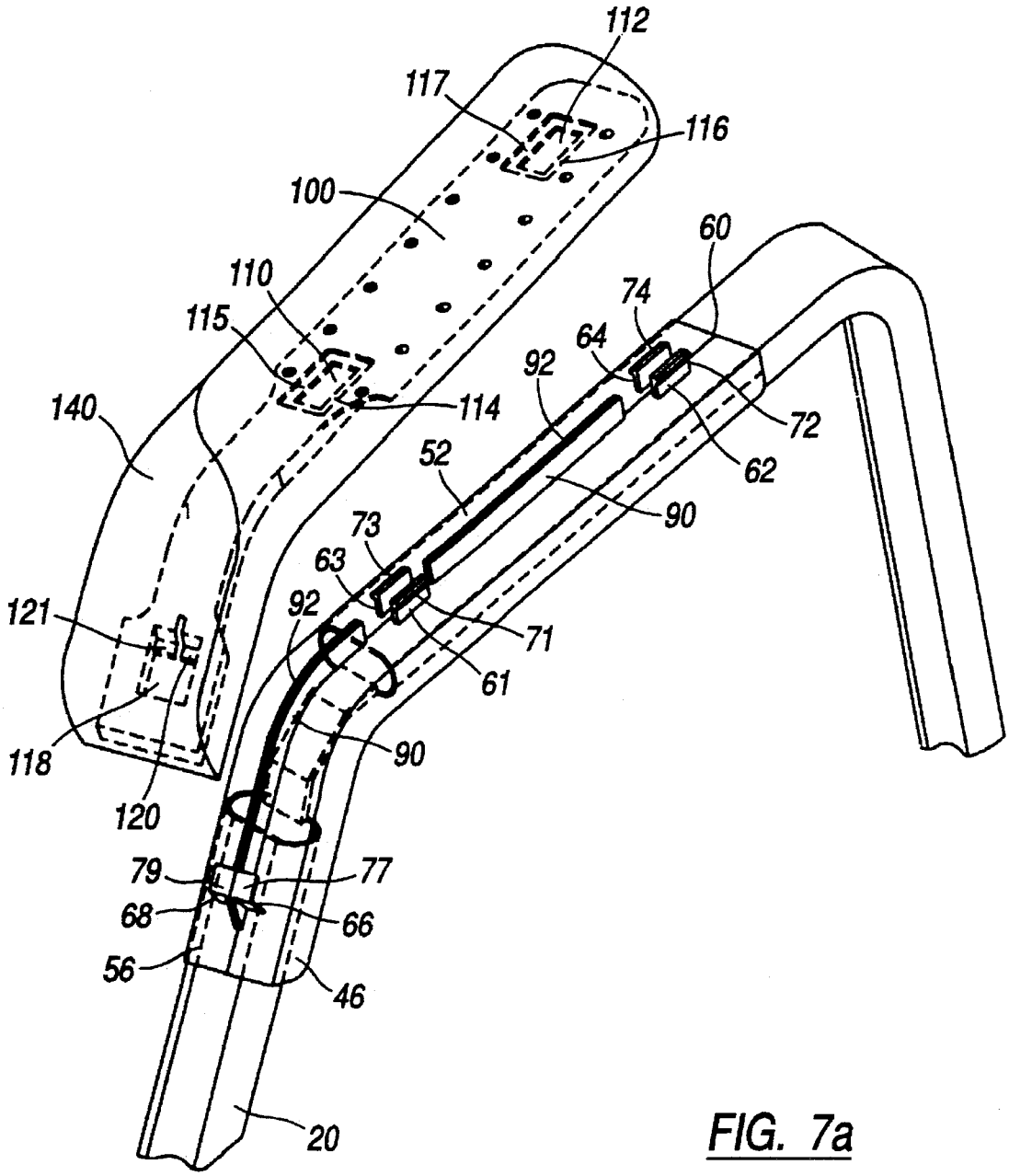
FIGS. 7*a* and 7*b* are isometric views of assembly of the arm rest adaptor of the present invention.
Figure 7B:
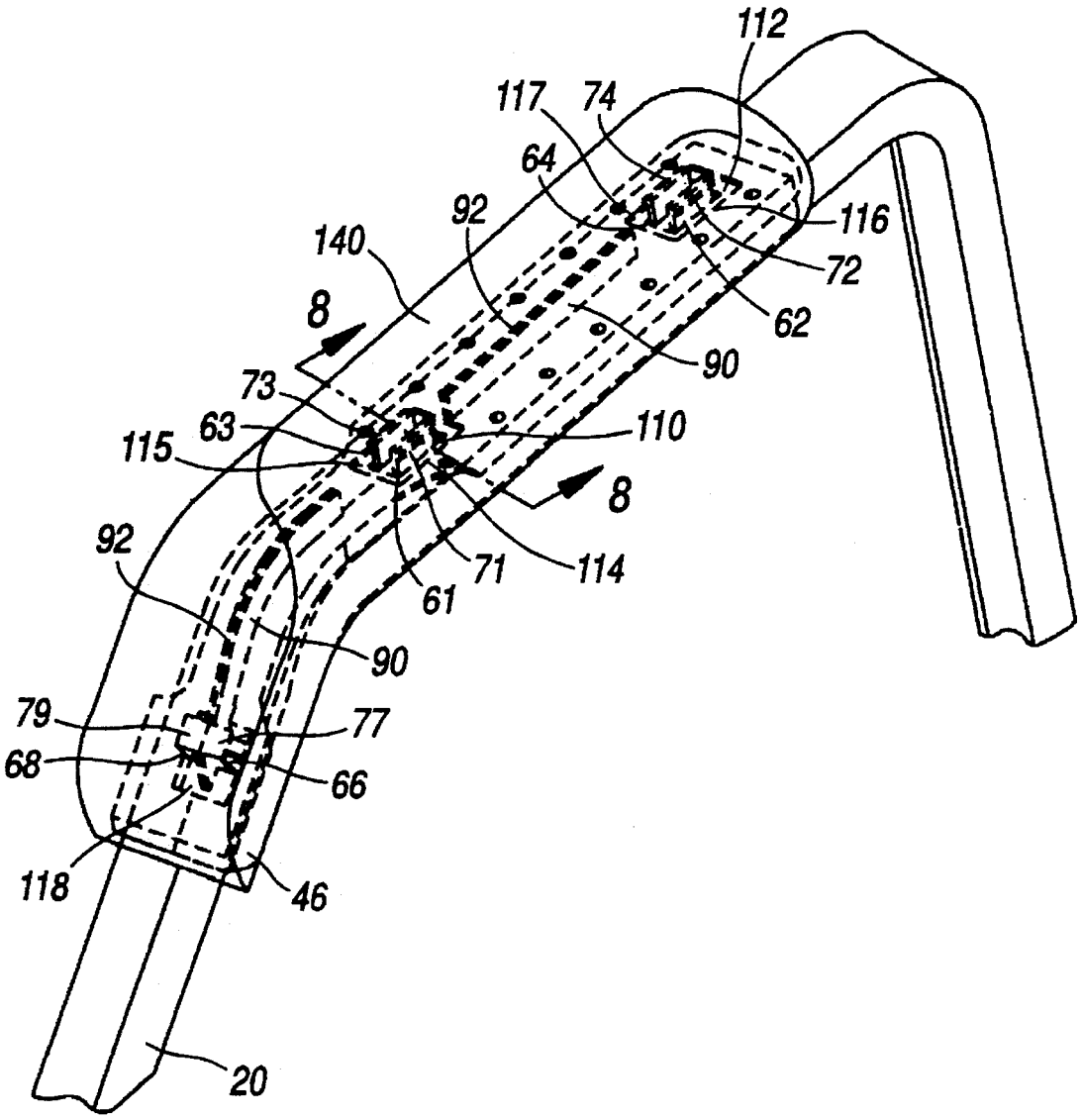

This structure provides for easy assembly as shown in FIGS. 7*a* and 7*b*. The two shells 42, 52 are slid over the armrest 20 to form the sleeve 60. The sleeve 60 has the first raised finger 61 on the first shell 42 and the first raised finger 63 on the second shell 52 aligned at even locations and a second raised finger 62 on the first 42 shell and the second raised finger 64 on the second shell 52 aligned at even locations, as well. When the shells 42, 52 are properly installed on the arm rest to form the sleeve 60, the raised fingers 61, 62, 63, 64 project upwardly and the L-shaped brackets 66, 68 project frontwardly. The arm pad 140 with the insert 100 integrally molded within are placed on top of the armrest 20 above the first and second shells 42, 52. Shelves 120, 121 in the top edge of the third port 118 within the arm pad 140 slide with the aid of beveled edges 122, 123 over vertical flanges 77, 79 of the first and second L-shaped brackets 66, 68, respectively. The engagement of the two brackets 66, 68 with shelves 120, 121 secures arm pad 140 and the insert 100 within the arm pad 140 to the vertical components 46, 56 of the shells 42, 52, respectively, thereby securing the arm pad 140 to the front member 30 of the armrest 20.

Once shelves 120, 121 are secured to the two L-shaped brackets 66, 68, the beveled ridges 114, 115 of the first port 110 in the insert 100 within the arm pad 140, contacts the extended edges 71, 73 of the first raised fingers 61, 63, respectively, which project into the channel 142. Additionally, the beveled ridges 116, 117 of the second port 112 of the insert 100 within the arm pad 140, contact the extended edge 72, 74 of the second raised fingers 62, 64 respectively, which project into the channel 142.

When the pad 140 is pushed down against the shells 42, 52, the beveled edge 71 of the raised finger 61 engages beveled ridge 114 of the port 110, the beveled edge 72 of the raised finger 62 engages the beveled ridge 115 of the port 110, the beveled edge 73 of the raised finger 63 engages the beveled ridge 116 of the port 112 and the beveled edge 74 of the raised finger 64 engages the beveled ridge 117 of the port 112. When sufficient force is applied, the beveled ridges 114, 115, 116, 117 serve as a ramp to urge the respective raised fingers 61, 62, 63, 64 to bend inwardly until the beveled ridges 114, 115, 116, 117 of the first and second ports 110, 112 descend below and no longer engage the beveled edges 71, 72, 73, 74 of the raised fingers 61, 62, 63, 64, respectively. Consequently, the beveled edges 71, 72, 73, 74 snap above the beveled ridges 114, 115, 116, 117 of the ports 110, 112 to effect a positive locking arrangement, thereby latching the arm pad 140 to the first shell 42 and the second shell 52 as shown in FIG. 7*b*.

Once the positive locking of the insert 100 to the shells 42, 52 is effected, the insert 100 and shells 42, 52 cannot be easily separated. Additionally, the ridges 114, 115 of the port 110 inwardly constrain the raised fingers 61, 62, respectively, and the ridges 116, 117 of the port 112 inwardly constrain the raised fingers 63, 64, respectively, to prevent the shells 42, 52 from sliding off the arm rest 20.

Figure 8:
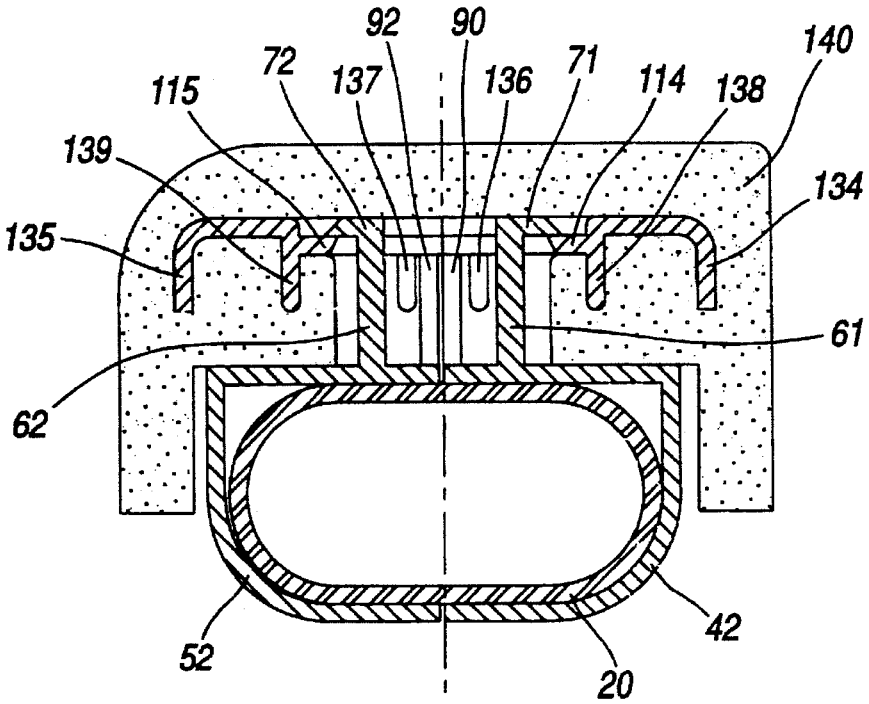
FIG. 8 is a cut-away section view of an assembled arm rest adapter assembly.

As shown in the cross section of FIG. 8, the first and second fins 90, 92 along the inner edge of the first shell 42 and the second shell 52, respectively, fit within the inside fins 136, 137 running down the center of the underside 108 of the insert 100. This enhances the secure engagement of the arm pad 140 to the shells 42, 52 even further by restraining the shells 42, 52 from twisting around the arm rest 20.

This arrangement provides for easy assembly and a sturdy construction without any noticeable fasteners. Relatedly, no holes must be cut in the arm rest to attach the arm pad to the arm rest, thereby avoiding additional manufacturing cost.

Figure 9:
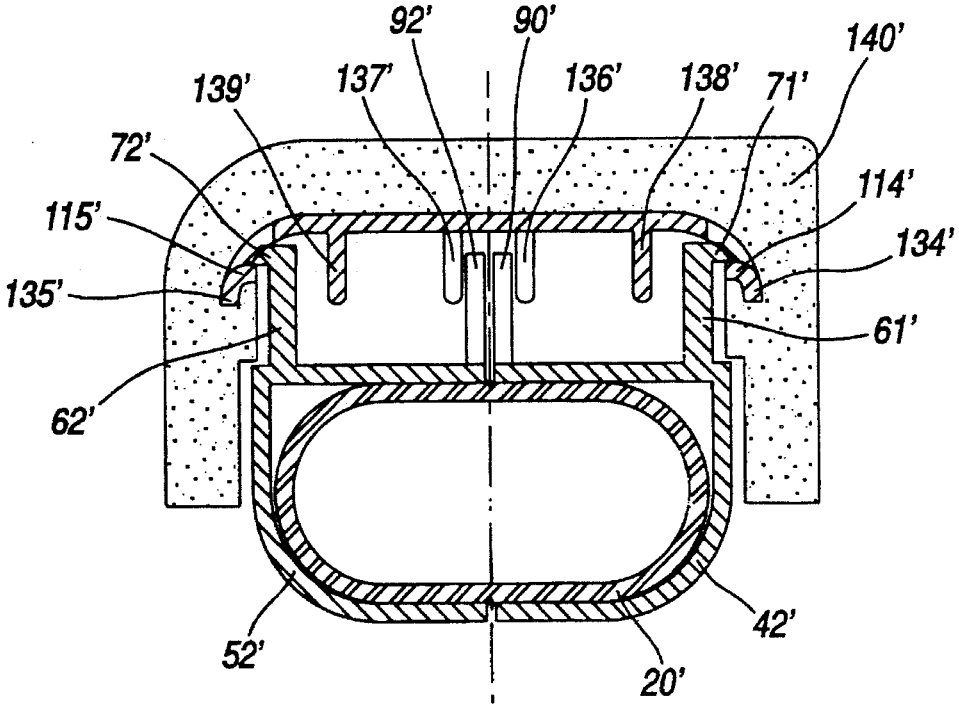
FIG. 9 is a cut-away section view of an assembled arm rest adapter assembly of an alternative embodiment of the present invention.
Figure 10:
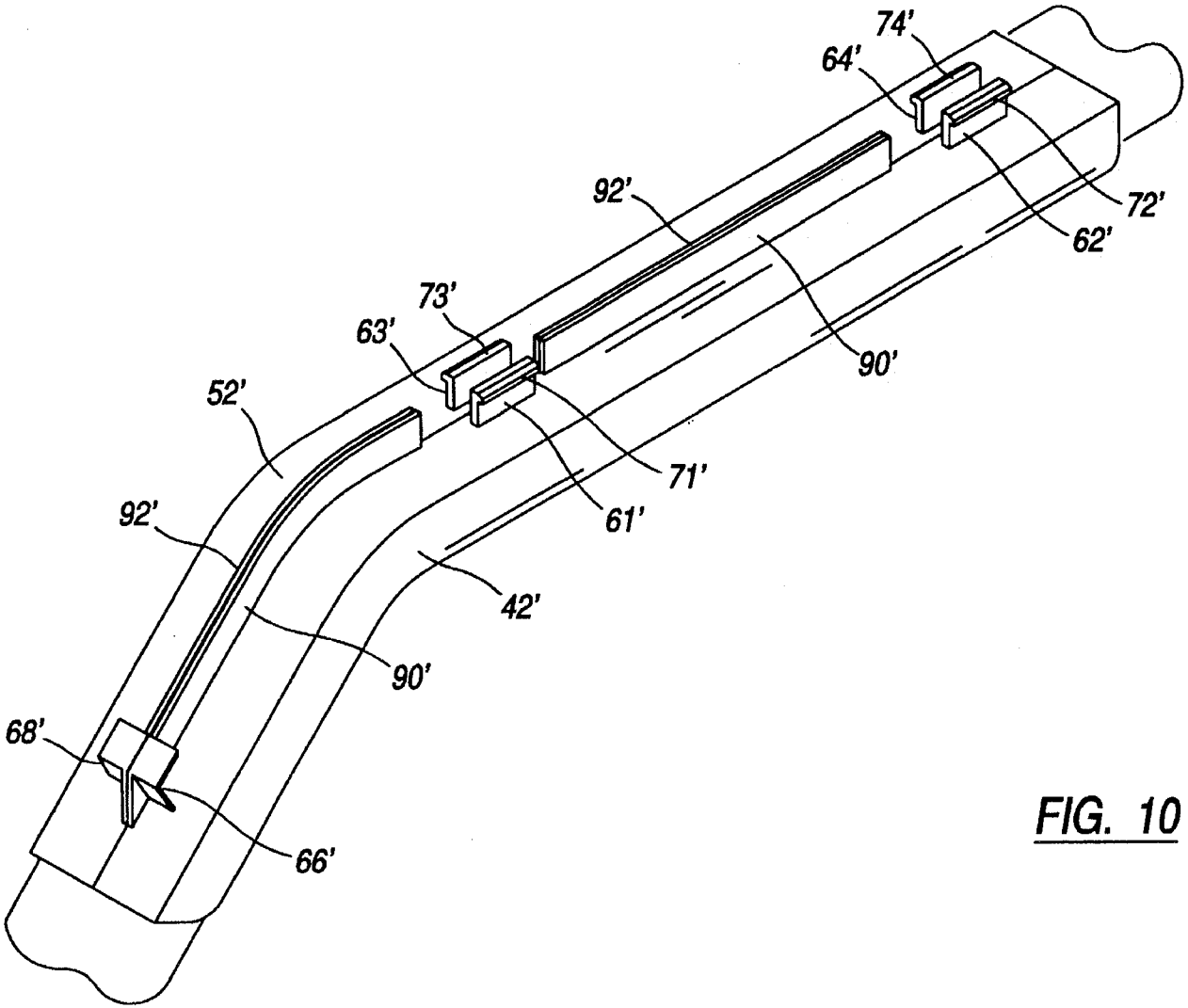
FIG. 10 is an isometric view of a first shell and a second shell of the alternative embodiment assembled onto an arm rest.
Figure 11:
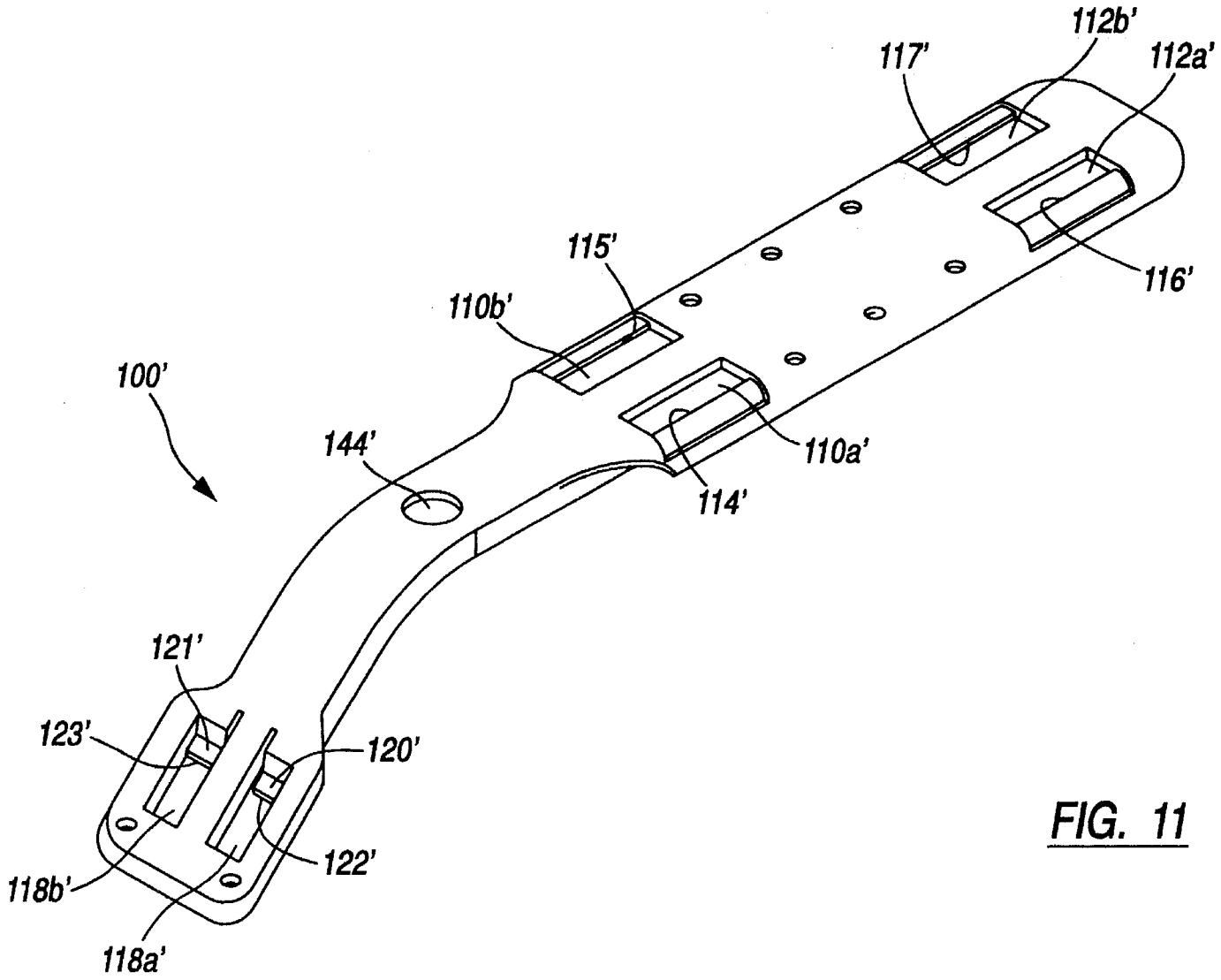
FIG. 11 is an isometric view of a top side of an insert of the alternative embodiment of the present invention.
Figure 12:
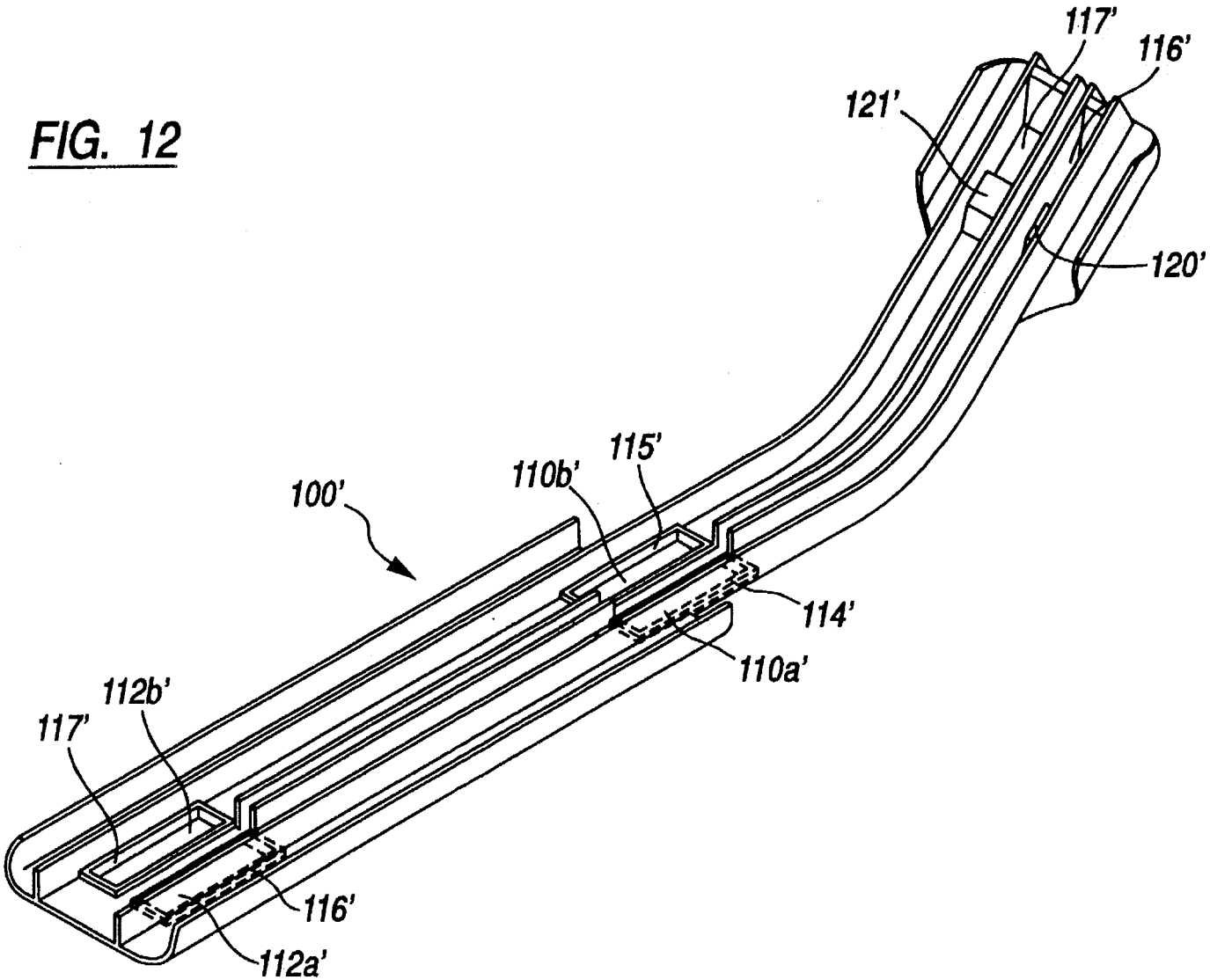
FIG. 12 is an isometric view of an underside of the insert of the alternative embodiment of the present invention.

The cross section of a completed assembly of an alternative embodiment is shown in FIG. 9. FIG. 10 shows a first shell 42' and a second shell 52' of the alternative embodiment, and FIGS. 11 and 12 show the top and bottom views of an insert of the alternative embodiment Raised fingers 61', 62', 63', 64' are moved toward the outside of the first and second shells 42', 52'. Accordingly, the space between ridges 114', 115' of port 110' and ridges 116', 117' of a port 112' must also be increased to maintain alignment of the beveled edges 71', 72', 73', 74' of the raised fingers 61', 62', 63', 64' with the corresponding ridges 114', 115', 116', 117', respectively. This spacing may be increased by expanding the width of the port 110', 112' or by providing two ports 110*a'*, 110*b'*, 112*a'*, 112*b'* on the outside of the insert 100 with partitions in between as shown in FIGS. 11 and 12.

Additionally, in the alternative embodiment, L-shaped brackets 66', 68' are also moved toward the outside of the shell 42', 52'. The width of a duct must be widened to maintain the brackets 66', 68' in alignment with the shelves 120' and 121'. Alternatively, two ducts 118*a'*, 118*b'* are provided with shelves 120' and 121', respectively, with a partition therebetween as shown in FIGS. 11 and 12.

The components of the alternative embodiment assemble together the same way as do the components of the first embodiment. The only difference is that the latching arrangements are engaged toward the outside of the assembly.

Although the invention has been described in conjunction with the foregoing specific embodiments, many alternatives, variations, and modifications will be apparent to those of ordinary skill in the art. Those alternatives, variations, and modifications are intended to fall within the scope of the appended claims.

What is claimed is:

1. An assembly which secures an arm pad to an elongated portion of an arm rest of a chair comprising:

an elongated sleeve having a longitudinal bore therein and having at least one open end, said sleeve being of sufficient width to receive and envelope said elongated portion of said arm rest;

a first raised finger with an extended edge on said sleeve;

said arm pad having a first port disposed at a position in registry with said raised finger and having a first ridge, said extended edge of said first raised finger latching said ridge when said ridge is urged into engagement with said extended edge to hold said arm pad to said sleeve.

2. The assembly of claim 1 having a first pair of opposed raised fingers comprising said first raised finger and a second raised finger, the extended edge of said first raised finger extending away from said second raised finger, said second raised finger having an extended edge extending away from said first raised finger; and said first port of said arm pad being disposed at a position in registry with said first pair of opposed raised fingers, said first port permitting access to said first ridge and a second ridge of said first port, said extended edge of said first raised finger latching said first ridge and said extended edge of said second raised finger latching said second ridge when said first port is urged into engagement with said first pair of opposed raised fingers.

3. The assembly of claim 2 wherein said arm pad has a duct disposed longitudinally remote from said first port, sad duct provides access to a shelf recessed below an underside surface of said arm pad and said sleeve has a first L-shaped bracket attached by a horizontal flange to said sleeve; said first L-shaped bracket being disposed in registry with the self in said duct so a vertical flange of said first L-shaped bracket slidably engages said shelf to additionally secure the arm pad to said sleeve receiving said arm rest.

4. The assembly of claim 3 having a second pair of opposed raised fingers comprising a first raised finger and a second raised finger, an extended edge of said first raised finger extending away from said second raised finger, said second raised finger having an extended edge extending away from said first raised finger; and a second port of said arm pad being disposed at a position in registry with said second pair of opposed raised fingers, said second port permitting access to a first ridge and a second ridge of said second port, said extended edge of said first raised finger latching said first ridge and said extended edge of said second raised finger latching said second ridge when said second port is urged into engagement with said second pair of opposed raised fingers.

5. The assembly of claim 4 wherein said elongated sleeve comprises a first half shell and a second half shell which slidably receive and clutch said arm rest; the first raised finger of said first pair of opposed raised fingers and the first raised finger of said second pair of opposed raised fingers being disposed on said first half shell and the second raised finger of said first pair of opposed raised fingers and the second raised finger of said second pair of opposed raised fingers being disposed on said second half shell; and said first ridge and said second ridge of said first port inwardly constrains said first raised finger and said second raised finger of said first pair of opposed raised fingers, and said first ridge and said second ridge of said second port inwardly constrains said first raised finger and said second raised finger of said second pair of opposed raised fingers to maintain said first shell and said second shell clutched to said arm rest upon latching.

6. The assembly of claim 5 having said first L-shaped bracket attached by said horizontal flange to said first shell, a second L-shaped bracket attached by a horizontal flange to Said second shell and said shelf being positioned even with said vertical flange of said first L-shaped bracket and a vertical flange of said second L-shaped bracket, so said vertical flange of said first L-shaped bracket and said vertical flange of said second L-shaped bracket slidably engage said shelf to additionally secure said arm pad to said first shell and said second shell.

7. The assembly of claim 6 wherein the extended edge of said first raised finger and the extended edge of said second raised finger in said first pair of opposed raised fingers and the extended edge of said first raised finger and the extended edge of said second raised finger in said second pair of opposed raised fingers are beveled, and the first ridge and the second ridge of said port and the first ridge and the second ridge of said second port are beveled to facilitate the urging of said first ridge and said second ridge of said port into latching engagement with said extended edges of said first raised finger and said second raised finger of said first pair of opposed raised fingers and the urging of said first ridge and said second ridge of said second port into latching engagement with said extended edges of said first raised finger and said second raised finger of said second pair of opposed raised fingers.

8. The assembly of claim 7 wherein the recessed shelf of said duct has a beveled edge for facilitating the sliding engagement of said vertical flange of said first L-shaped bracket and said vertical flange of said second L-shaped bracket with said shelf.

9. The assembly of claim 8 wherein said pad is attached to an insert for enhancing the rigidity of said pad, said insert providing said first port with said first ridge and said second ridge and a second port with said first ridge and said second ridge.

10. The assembly of claim 9 wherein said insert provides said duct with said recessed shelf.

11. The assembly of claim 10 wherein said pad is attached to said insert by molding a resilient material around said insert and leaving a channel which exposes said first port, said second port and said duct.

12. The assembly of claim 11 wherein said insert is engulfed by said arm pad.

13. The assembly of claim 12 wherein said first shell has a vertical component and a horizontal component, said first raised finger of said first pair of opposed raised fingers and said first raised finger of said second pair of opposed raised fingers are located on said horizontal component of said first shell, and said first L-shaped bracket attached to said first shell is located on said vertical component of said first shell; said second shell has a vertical component and a horizontal component, said second raised finger of said first pair of opposed raised fingers and said second raised finger of said second pair of opposed raised fingers are located on said horizontal component of said second shell, and said second L-shaped bracket attached to said second shell is located on said vertical component of said second shell.

14. The assembly of claim 13 wherein said first half shell and said second half shell have a C-shaped cross-sectional configuration.

15. The assembly of claim 11 wherein said insert has a plurality of apertures for enabling the flow of said resilient material into said plurality of apertures during molding to ensure that said pad is securely attached to said insert.

16. The assembly of claim 15 wherein a first axial fin disposed vertically on an inner edge of said first shell and a second axial fin on an inner edge of said second shell are received by a pair of fins running down the insert to additionally restrain said shells from sliding off said arm rest.

17. The assembly of claim 16 wherein said resilient material of said arm pad is made of polyurethane.

18. A chair with an assembly which secures an arm pad to an elongated portion of an arm rest of said chair comprising:

an elongated shell forming a longitudinal sleeve with a longitudinal bore therein, and having at least one open end, said sleeve being of sufficient width to receive said arm rest to envelope a desired length of said arm rest;

a first pair of raised fingers including a first raised finger and a second raised finger on said shell, said first raised finger having an extended edge extending away from said second raised finger said second raised finger having an extended edge extending away from said first raised finger;

a first port in said arm pad at a position in registry with the first pair of raised fingers and having a first ridge and a second ridge, said extended edge of said first raised finger latching said first ridge and said extended edge of said second raised finger latching said second ridge when said first port is urged into engagement with said first pair of raised fingers.

19. The assembly of claim 18 wherein said arm pad has a duct disposed longitudinally remote from said first port, said duct has a shelf recessed below an underside surface of said arm pad and said sleeve has a first L-shaped bracket attached by a horizontal flange to said sleeve; said first L-shaped bracket being disposed in registry with the shelf so a vertical flange of said first L-shaped bracket slidably engages said shelf to additionally secure the arm pad to said sleeve.

20. The assembly of claim 19 having a second pair of opposed raised fingers comprising a first raised finger and a second raised finger, said first raised finger having an extended edge extending away from said second raised finger, said second raised finger having an extended edge extending away from said first raised finger; and a second port disposed at a position in registry with said second pair of opposed raised fingers and having a first ridge and a second ridge, said extended edge of said first raised finger latching said first ridge and said extended edge of said second raised finger latching said second ridge when said second port is urged into engagement with said second pair of raised fingers.

21. The assembly of claim 20 wherein said elongated sleeve comprises a first half shell and a second half shell and the first raised finger of said first pair of opposed raised fingers and the first raised finger of said second pair of opposed raised fingers are disposed on said first half shell and the second raised finger of said first pair of opposed raised fingers and the second raised finger of said second pair of opposed raised fingers are disposed on said second half shell.

22. The assembly of claim 21 having said first L-shaped bracket attached by said horizontal flange to said first shell, a second L-shaped bracket with a horizontal flange and a vertical flange attached by said horizontal flange to said second shell, and said recessed shelf on said duct having sufficient width to slidably engage said vertical flange of said first L-shaped bracket and said vertical flange of said second L-shaped bracket to additionally secure said arm pad to said first shell and said second shell.

23. The assembly of claim 22 wherein said pad is attached to an insert for enhancing the rigidity of said pad, said insert providing said first port with said first ridge and said second ridge, said second port with said first ridge and said second ridge and said duct with said recessed shelf.

24. The assembly of claim 23 wherein said pad is attached to said insert by molding said pad around said insert and leaving a channel which exposes said first port, said second port and said duct.

* * * * *